US009670765B2

(12) United States Patent
Magi et al.

(10) Patent No.: US 9,670,765 B2
(45) Date of Patent: Jun. 6, 2017

(54) VARIABLE ASSET MULTIPHASE EJECTOR FOR PRODUCTION RECOVERY AT THE WELLHEAD

(71) Applicant: ENI S.p.A., Rome (IT)

(72) Inventors: Stefano Magi, San Donato Milanese (IT); Gianfederico Citi, Milan (IT); Lorenzo Di Berardo, Teramo (IT); Paolo Andreussi, Pisa (IT); Alberto Ansiati, Prato (IT)

(73) Assignee: ENI S.p.A., Rome (IT)

( * ) Notice: Subject to any disclaimer, the term of this patent is extended or adjusted under 35 U.S.C. 154(b) by 343 days.

(21) Appl. No.: 14/365,280

(22) PCT Filed: Dec. 12, 2012

(86) PCT No.: PCT/IB2012/057217

§ 371 (c)(1),
(2) Date: Jun. 13, 2014

(87) PCT Pub. No.: WO2013/088355

PCT Pub. Date: Jun. 20, 2013

(65) Prior Publication Data

US 2014/0346250 A1 Nov. 27, 2014

(30) Foreign Application Priority Data

Dec. 14, 2011 (IT) ..... MI2011A002261

(51) Int. Cl.
*F04F 5/48* (2006.01)
*E21B 43/40* (2006.01)
(Continued)

(52) U.S. Cl.
CPC ..... *E21B 43/40* (2013.01); *F04F 5/24* (2013.01); *F04F 5/46* (2013.01); *F04F 5/461* (2013.01)

(58) Field of Classification Search
CPC ..... E21B 43/40; F04F 5/24; F04F 5/46; F04F 5/461
(Continued)

(56) References Cited

U.S. PATENT DOCUMENTS 1,421,843 A 7/1922 Schmidt
2,623,474 A * 12/1952 Friedmann ..... F04F 5/461 417/178
(Continued)

FOREIGN PATENT DOCUMENTS

DE 260420 C 5/1913
SU 1343118 A1 10/1987
(Continued)

OTHER PUBLICATIONS

International Search Report and Written Opinion issued Mar. 8, 2013 in PCT/IB2012/057217.
(Continued)

*Primary Examiner* — Charles Freay
(74) *Attorney, Agent, or Firm* — Oblon, McClelland, Maier & Neustadt, L.L.P.

(57) ABSTRACT

A multiphase ejector including a housing space with a first inlet opening, connectable to a first fluid source, a second inlet opening, connectable to a second fluid source, and an outlet opening. A bush inside the housing space includes a channel having a first opening connected to the first inlet opening and a second opening connected to the second inlet opening and the outlet opening. A member inside the space mixes the fluids and demlimits a channel with a first opening connected to the second opening of the channel and to the second inlet opening, and a second opening connected to the outlet opening. A restriction associated with the bush adjusts the flow-rate of the first fluid in the second opening of the channel. The restriction can be moved between a position of
(Continued)

an area having a maximum amplitude, and a position of the second opening being blocked.

4 Claims, 1 Drawing Sheet

(51) Int. Cl.
*F04F 5/46* (2006.01)
*F04F 5/24* (2006.01)

(58) Field of Classification Search
USPC ..... 417/185
See application file for complete search history.

(56) References Cited

U.S. PATENT DOCUMENTS 3,200,764 A * 8/1965 Saunders, Jr. ..... B01F 5/0416 417/185
3,776,470 A * 12/1973 Tsuchiya ..... B05B 1/32 239/265.43
4,595,344 A * 6/1986 Briley ..... F04F 5/48 239/546
2009/0311111 A1 12/2009 Yoshii

FOREIGN PATENT DOCUMENTS

SU 1393935 A1 5/1988
SU 1525340 A1 11/1989
SU 1710856 A1 2/1992
SU 1779800 A1 12/1992

OTHER PUBLICATIONS

Office Action issued Nov. 20, 2015 in Kazak Patent Application No. 2014/1628.1 (with English language translation).

* cited by examiner

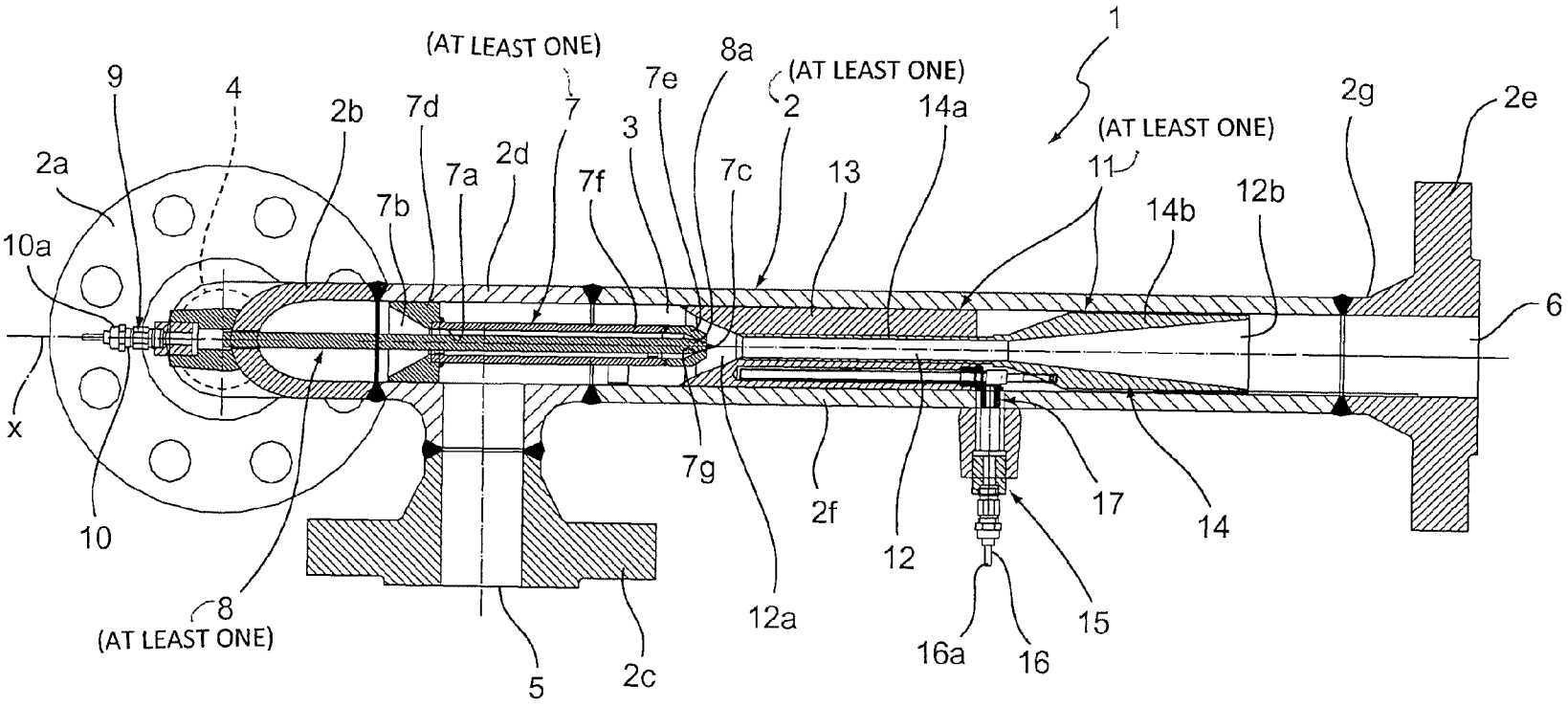
1
2e
6
2g
12b
(AT LEAST ONE)
11
14b
14
17
15
16
16a
(AT LEAST ONE)
14a
12
13
2f
(AT LEAST ONE)
2
12a
8a
7c
7g
7e
3
7f
2c
(AT LEAST ONE)
7
5
2d
7a
7d
7b
2b
4
8
(AT LEAST ONE)
9
10
2a
10a
x

VARIABLE ASSET MULTIPHASE EJECTOR FOR PRODUCTION RECOVERY AT THE WELLHEAD

The present invention relates to a variable asset multiphase ejector.

The object of the present invention is used in the oil industry and, in particular, is suitable for being used in production facilities for on-shore, off-shore (topside) and subsea multiphase hydrocarbon fields.

More specifically, the object of the present invention relates to technologies destined for the handling and boosting of multiphase streams coming from high-pressure and low-pressure wells.

Boosting techniques of multiphase streams which exploit the energy of high-pressure wells to suck the multiphase stream present in low-pressure wells, are known in the oil industry and related fields.

These boosting techniques are actuated by means of suitable multiphase ejectors or similar jet pumps in which a high-pressure flow, called "drive", is mixed, transferring energy, with a low-pressure flow called "suction".

The ejectors or jet pumps generally have simple structures and configurations in which all the components are static and do not have movable parts, allowing a great degree of reliability at a low cost.

The majority of multiphase ejectors and jet pumps on the market are mainly concentrated on applications destined for the handling of gas. Some examples of ejectors destined only for the handling of gas are equipped with a nozzle capable of being calibrated in order to optimize the use of drive gas with a variation in the flow conditions.

For wells producing multiphase flows, the necessity of using at least one separator upstream of the ejector or jet pump, considerably limits on-site applications of the known devices, especially with respect to developments of the underwater type.

For multiphase applications, a gas/liquid separator is normally used, which is positioned both upstream of the ejector, for the movement of the gas, and upstream of the movement pump, for the movement of the liquid phase.

In this case, the ejectors have a static configuration and are capable of treating oil, gas and water, as "drive" and "suction" flows. This type of ejector can be used in refineries, chemical industries, cooling plants and for the production of urea.

For "on-shore" applications, ejectors, eductors, thermocompressors, vacuum systems, jet mixers for the fine chemical industry and oil transformation, are also known, whose structures, destined for handling fluids, have static configurations.

An example of a multiphase ejector with a static configuration, similar to those mentioned above, is described and illustrated in the document GB2384027. More specifically, this ejector comprises a structure having a first inlet opening suitable for being connected to a first feeding source of a high-pressure fluid and a second inlet opening connectable to a second feeding source of a low-pressure fluid. The structure also comprises an outlet opening for the discharge of the fluids at the inlet of the first and second openings. The ejector comprises an inlet bush positioned in correspondence with the first opening. The inlet bush defines a section narrowing for the passage of the first fluid coming from the first opening.

The ejector also comprises, between the inlet openings and the outlet opening, a mixing chamber for mixing the fluids coming from the first and second inlet opening.

The structure of the ejector has a static configuration which cannot change during its use. The variation in the structural configuration is only possible after dismantling the components and replacing them with other components having different dimensions.

Although the commercial diffusion of the above-mentioned multiphase ejectors or jet pumps is particularly relevant, the Applicant has found that multiphase ejectors, in particular for applications in the oil industry, have various drawbacks and several aspects can be improved, mainly with respect to the efficiency, flexibility of use, versatility, practicalness and configuration simplicity in both on-shore and off-shore and subsea applications, structural strength and also resistance to high pressures.

In particular, the Applicant has found that the main drawbacks associated with the use of known multiphase ejectors are caused by their poor efficiency and flexibility.

As is known, the efficiency of a multiphase ejector decreases when the operating conditions diverge from the project conditions. The restricted flexibility therefore limits its use in oil and gas fields due to the variation, with time, in the flowing parameters of the wells due, for example, to the natural depletion of the reservoir or to the increase in the "water cut" or "GOR", i.e. the gas/oil ratio.

The ratio between the maximum and minimum value of each of the variables mentioned above, normalized to the unit, called "rangeability", for which the accuracy and precision data of an ejector are valid, can be improved using different internal structures and configurations. This requires, however, the partial or complete replacement of the ejector parts.

Each intervention of this type implies a shut-down of the facilities and cannot be done in the case of underwater applications.

Some solutions include the provision of batteries of two or more ejectors, each specifically configured for a particular operating condition of the field. It should be noted however that this solution requires an accurate prediction of the various life phases of the reservoirs in order to provide different configurations capable of operating optimally once selected.

The main objective of the present invention is to solve the drawbacks observed in the known art.

An objective of the present invention is to provide an efficient multiphase ejector.

A further objective of the present invention is to propose a versatile multiphase ejector capable of adapting itself to variations in the reservoir with time.

Another objective of the present invention is to provide a multiphase ejector which is suitable for being used in on-shore applications and also in off-shore and underwater applications.

A further objective of the present invention is to propose a simple and practical multiphase ejector to be configured.

Yet another objective of the present invention is to provide a multiphase ejector with a robust design resistant to high pressures, such as for example those present in deep and ultra-deep water developments.

An additional objective is to provide an ejector which is inexpensive to produce and commercialize.

A final objective of the present invention is to propose a multiphase ejector whose structural configuration can be remotely modified.

The objectives specified above, and also others, are substantially achieved by a multiphase ejector as expressed and described in the following claims. This ejector can be optimized at a project level, in relation to the operative conditions, by using a specific one-dimensional multiphase code, developed by the Applicant, used for the design of the internal geometry and for verifying the performances of the ejector.

A description is now provided for illustrative purposes, of a preferred but not exclusive design of a multiphase ejector, according to the present invention. This description makes reference to the enclosed drawing, provided for purely indicative and consequently non-limiting purposes, in which a multiphase ejector according to the present invention is represented in a sectional view.

As schematically represented in the enclosed FIGURE, a multiphase ejector, according to the present invention, is indicated as a whole with the number 1.

The multiphase ejector 1 comprises at least one hollow structure 2 delimiting a housing space 3.

The hollow structure 2 is equipped with a first inlet opening 4, connectable to a first feeding source (not represented in the enclosed FIGURE) of a first multiphase fluid, in particular a first well or similar reservoir, having a first pressure value.

As can be seen in FIG. 1, the first inlet opening 4 is situated in a first connection flange 2*a* arranged at a first end 2*b* of the hollow structure 2.

The hollow structure 2 is provided with a second inlet opening 5, connectable to a second feeding source (not represented as it is known) of a second multiphase fluid, in particular a second well or similar reservoir, having a second pressure value lower than the first pressure value of said first fluid.

As can be seen in FIG. 1, the second inlet opening 5 is situated in a second connection flange 2*c* of said hollow structure 2 which is welded to an intermediate connector 2*d* for hydraulic connection 2*f* which, in turn, is welded to the first end 2*b* of the hollow structure and to a tubular portion 2*g* of the same, on the opposite side with respect to the first end 2*b*.

The hollow structure 2 also has an outlet opening 6 for the discharge of the multiphase fluids at the inlet through the inlet openings 4, 5.

As can be seen in FIG. 1, the outlet opening 6 is obtained through a third connection flange 2*e* of the hollow structure 2 arranged at a second end 2*g* of the same and welded to the tubular portion 2*f* on the side opposite to the intermediate connector 2*d*.

Again with reference to FIG. 1, the multiphase ejector 1 comprises at least one bush 7 positioned inside the housing space 3 close to the first inlet opening 4.

In detail, the bush 7 is at least partially positioned inside the intermediate connector 2*d* of the hollow structure 2, in correspondence with the second inlet opening 5.

As can be seen in FIG. 1, a transit channel 7*a* passes longitudinally through the bush 7, said channel having a first opening 7*b* in fluid communication with the first inlet opening 4 of the hollow structure 2 and, a second opening 7*c*, in fluid communication with the second inlet opening 5 and the outlet opening 6 of the hollow structure 2.

More specifically, the first opening 7*b* of the transit channel 7*a* of the bush 7 broadens as it moves away from the respective second opening 7*c* according to a substantially truncated-conical flaring created in a cylindrical portion 7*d* of the bush 7 seal-buffered against the internal surface of the housing space 3 in the section defined by the intermediate connection 2*d*.

The second opening 7*c* of the transit channel 7*a* of the bush 7 is situated in correspondence with a free end 7*e* of a tubular portion 7*f* of the bush 7 which extends from said cylindrical portion 7*d* towards the outlet opening 6 of the hollow structure 2.

More specifically, the second opening 7*c* of the transit channel 7*a* of the bush 7 becomes narrower as it moves away from the respective first opening 7*b* defining a respective substantially internal truncated-conical surface 7*g*.

As can be seen in FIG. 1, the section of the tubular portion 7*f* of the bush 7 is below the section of the housing space 3 and consequently the transit channel 7*a* and second opening 7*c* of the latter form a restriction for the first high-pressure multiphase fluid coming from the first inlet opening 4.

The multiphase ejector 1 advantageously comprises at least one restricting pin 8 operatively associated with the bush 7 for regulating the passage area of said first fluid, in correspondence with said second opening 7*c* of the transit channel 7*a*. In other words, the restricting pin 8 allows the amplitude of the passage area delimited between the second opening 7*c* of the transit channel 7*a* and the restricting pin 8, to be regulated.

In order to regulate the amplitude of the above-mentioned passage area, the restricting pin 8 can be advantageously moved between a first position, in which the passage area defined between the restricting pin 8 and the second opening 7*c* of the transit channel 7*a* of the bush 7 has a maximum amplitude (not represented in the FIGURE), and a second position (FIG. 1), in which the second opening 7*c* of the transit channel 7*a* of the bush 7 is blocked by the restricting pin 8.

The variations in the passage area between the maximum and minimum amplitude (FIG. 1) allow a variation in the critical section of the transit channel 7*a* and consequently the flow-rate of the first high-pressure fluid coming from the first inlet opening 4. In this way, it is advantageously possible to adapt the configuration of the multiphase ejector 1 in relation to variations, with time, in the operating conditions of the first feeding source of the first high-pressure fluid and second feeding source of the second low-pressure fluid.

Again with reference to FIG. 1, the restricting pin 8 at least partially develops along the transit channel 7*a* of the bush 7 and, in correspondence with the second opening 7*c* of the latter, has a tilted external surface 8*a*, substantially conical, which narrows as it moves away from the first opening 7*b*.

The outer tilted surface 8*a* is arranged so as to be at least partly buffered against the internal truncated-conical surface 7*g* of the second opening 7*c* of the transit channel 7*a* when the restricting pin 8 is in the second position.

The multiphase ejector 1 also comprises driving means 9 operatively associated with the hollow structure 2 for moving, from the outside, the restricting pin 8 between the first and second position.

As can be seen in FIG. 1, the driving means 9 comprise one driving member 10 rotating around a respective rotation axis X according to a first rotation direction for moving the restricting pin 8 from the first to the second position (FIG. 1), and according to a second rotation direction, contrary to the first rotation direction, for moving the restricting pin 8 from the second to the first position.

The driving member 10 is operatively engaged with an end 8*b* of the restricting pin 8 which passes through the first end 2*b* of the hollow structure 2 on the side opposite to the conical surface 8*a* so that the commands of the driving member 10 correspond to respective translations of the restricting pin between the first and second position.

The driving organ 10 advantageously has a connecting portion 10*a* suitable for being engaged with a respective tool through which it is possible to actuate the rotation of the driving member itself in one rotation direction or another.

Alternatively, the driving member 10 can be operatively connected to a respective automatic actuation means, such as for example a motor or a similar actuator that can be activated at a distance and in remote-control by an appropriate control and/or driving unit.

The multiphase ejector 1 also comprises at least one mixing member 11 operatively positioned inside the housing space 3 in correspondence with the outlet opening 6 for mixing the first and second fluid respectively coming from the first and second inlet opening 4, 5.

As can be seen in FIG. 1, the mixing member 11 delimits a respective flow channel 12, with a narrow section, for the passage of mixing fluids.

The flow channel 12 advantageously has a first opening 12*a* in fluid communication with the second opening 7*c* of said transit channel 7*a* of the bush 7 and the second inlet opening 5 of the hollow structure 2, and a second opening 12*b*, in fluid communication with the outlet opening 6 of the hollow structure 2.

More specifically, the mixing member 11 comprises a first body 13 substantially cylindrical, in which the first opening 12*a* of the flow channel 12 is defined. The first body 13 has a substantially cylindrical conformation and is hermetically buffered against the internal surface of the housing space 3 in correspondence with the tubular portion 2*f* of the hollow structure 2.

The mixing member 11 also comprises a second body 14 having a stem 14*a* at least partially inserted in the first body 13 and a substantially cylindrical portion 14*b* integral with the stem 14*a* on the side opposite to the first body 13.

As can be seen in FIG. 1, the cylindrical portion 14*b* of the second body 14 defines the second opening 12*b* of the flow channel 12, which is in turn at least partially defined by the first body 13, and at least partially defined by the second body 14.

According to an advantageous aspect of the present invention, the length of the flow channel 12 of the mixing member 11 can be regulated between a first condition (FIG. 1), corresponding to a minimum length, and a second condition, corresponding to a maximum length.

The greater the length of the flow channel 12 of the mixing member 11, the greater the mixing degree will be of the multiphase fluids coming from the inlet openings 4, 5 of the hollow structure 2. Vice versa, with a decrease in the length of the flow channel 12 of the mixing member 11, the mixing degree of the first and second multiphase fluid will also be reduced.

In order to allow the overall length of the mixing member 11 to be regulated, the first and second body 13, 14 are advantageously movable relative to each other between a position of maximum insertion (FIG. 1) of the stem 14*a* of the second body 14 inside the first body 13, corresponding to the first regulation condition of the length of the flow channel 12, and a second position (not represented) of minimum insertion of the stem 14*a* of the second body 14 inside said first body 13, corresponding to the second regulation condition of the flow channel 12.

The multiphase ejector 1 preferably comprises driving auxiliary means 15 operatively associated with the mixing organ 11 for relatively moving, from the outside, the first and second body 13, 14 between the first and second position.

According to the embodiment solution illustrated in FIG. 1, the second body 14 of the mixing member 11 can be moved, longitudinally inside the hollow structure 2, with respect to the first body 13. In this case, the auxiliary driving means 15 comprise an auxiliary driving member 16 operatively engaged, by means of intermediate transmission means 17 of the known type, with the second body 14 of the mixing member 11.

The auxiliary driving member 16 can be rotated around a respective rotation axis Y according to a first rotation direction to actuate the movement of the second body 14 from the first to the second position, and according to a second rotation direction contrary to the first, to move the second body 14 from the second to the first position.

In order to stabilize the movement of the second body 14 of the mixing member 11 between the first and second position, the second body 14 is equipped with a guiding pin 18 which runs inside a respective opening 19 situated in the first body 13.

The auxiliary driving member 16 advantageously has a connecting portion 16*a* suitable for being engaged with a respective tool through which it is possible to actuate the rotation of the auxiliary driving member itself in one rotation direction or another.

Alternatively, the auxiliary driving member 16 can be operatively connected to a respective automatic actuation means, such as for example a motor or a similar actuator that can be activated at a distance and in remote-control by an appropriate control and/or driving unit.

The multiphase ejector 1 according to the present invention solves the problems revealed in the known art and offers important advantages.

First of all, the multiphase ejector described above is particularly efficient and flexible as it is able to adapt itself to variations with time in the flowing conditions of the wells and/or reservoirs of interest. More specifically, the presence of a variable asset provides the ejector with the capacity of adapting itself to the various operating conditions that can exist between different reservoirs in addition to the above-mentioned variations with time in the operating conditions of the same reservoirs.

Furthermore, the variable asset multiphase ejector described above allows a simplification of the known systems consisting of a plurality of static asset ejectors, as it is capable of completely substituting the latter, exerting the same functions according to a high-performance mode.

It should also be noted that the multiphase ejector described above is particularly versatile as it can be practically and simply used in both onshore, offshore and subsea applications.

As there is no longer the requirement of providing parts to be replaced and consequently dismantled, moreover, the above-mentioned multiphase ejector can be produced with a robust structure suitable for resisting high pressures. The above-mentioned multiphase ejector can therefore be easily used for considerable sea depths without requiring the expedients necessary for structures composed of components that must be substituted and disassembled.

It should also be observed that the variations in the configuration of the above-mentioned multiphase ejector can also be effected at a distance and in remote-control by connecting both the driving member of the restricting pin and the auxiliary driving member of the second body of the mixing member to corresponding automated movement means that can be actuated by appropriate control and/or driving units positioned for example on fixed offshore structures (e.g. platforms) or floating offshore vessels ("FPSO—Floating Production Storage Offloading").

The variable asset multiphase ejector described above advantageously allows a significant increase in production without additional operating costs. Furthermore; said multiphase ejector allows a considerable reduction in maintenance costs as it can be regulated in relation to the operating variations of wells without substitution of the structural components.

It should also be pointed out that the multiphase ejector described above does not require complex variations in the normal equipment used for producing recovery systems of multiphase fluids.

Last but not least, the above-mentioned multiphase ejector can be produced and sold at reduced costs by incorporating in a single model, numerous operating configurations capable of managing a variety of operating conditions of different reservoirs.

The invention claimed is:

1. A multiphase ejector comprising:

at least one hollow structure delimiting a housing space, said hollow structure including a first inlet opening, connectable to a first feeding source of a first fluid having a first pressure value, a second inlet opening, connectable to a second feeding source of a second fluid, having a second pressure value lower than the first pressure value of said first fluid, and at least one outlet opening;

at least one bush situated inside said housing space, said bush being longitudinally crossed by a transit channel having a first opening in fluid communication with said first inlet opening of said hollow structure and a second opening in fluid communication with said second inlet opening and said outlet opening of said hollow structure;

at least one mixing member operatively positioned inside said housing space in correspondence with said outlet opening for mixing said first and second fluid coming from said first and second inlet opening respectively, said mixing member delimiting at least one respective flow channel for passage of said fluids, said flow channel having a first opening in fluid communication with said second opening of said transit channel of said bush and said second inlet opening of said hollow structure, and a second opening in fluid communication with said outlet opening of said hollow structure, said at least one mixing member comprising: a first body substantially cylindrical, in which the first opening of the flow channel is defined; a second body including a stem at least partially inserted in said first body and a cylindrical portion integral with said stem, said cylindrical portion of said second body defining said second opening of said flow channel, said flow channel of said mixing member being at least partially defined by said first body, and at least partially defined by said second body; a length of said flow channel of said mixing member being regulated between a first condition, corresponding to a minimum length, and a second condition, corresponding to a maximum length; said first and second body of said mixing member being relatively moved with respect to each other between a first position of maximum insertion of said stem of said second body inside said first body, corresponding to a first regulation condition of the length of said flow channel, and a second position of minimum insertion of said stem of said second body inside said first body, corresponding to a second regulation condition of the length of said flow channel;

at least one restricting pin operatively associated with the bush for adjusting a passage area of said first fluid in correspondence with said second opening of said transit channel, said restricting pin being movable between a first position, in which the passage area defined between said restricting pin and said second opening of said transit channel of said bush has a maximum amplitude, and a second position, said second opening of said transit channel of said bush being closed by said restricting pin;

driving means operatively associated with said hollow structure for moving, from outside, said restricting pin between the first and second position; and auxiliary driving means operatively associated with said mixing member for relatively moving, from outside, said first and second body between the first position and the second position.

2. The multiphase ejector according to claim 1, wherein said driving means comprises at least one driving member rotatable around a respective rotation axis according to a first rotation direction for moving said restricting pin from the first position to the second position, and according to a second rotation direction, contrary to the first rotation direction, for moving said restricting pin from the second position to the first position.

3. The multiphase ejector according to claim 1, wherein:

said second opening of said transit channel of said bush narrows as it moves away from the respective first opening, said restricting pin at least partially developing along said transit channel and having, in correspondence with said second opening, a substantially conical tilted outer surface which narrows as it moves away from the first opening;

said first opening of said transit channel of said bush broadens as it moves away from the respective second opening according to a substantially truncated-conical flaring.

4. The multiphase ejector according to claim 1, wherein said second body can be moved, longitudinally inside said hollow structure, with respect to said first body, said auxiliary driving means comprising an auxiliary driving member operatively engaged with said second body, said auxiliary driving member being rotatable around a respective rotation axis according to a first rotation direction to actuate the movement of said second body from the first position to the second position, and being rotatable around the respective rotation axis according to a second rotation direction contrary to the first, to move said second body from the second position to the first position.

* * * * *